United States Patent [19]

Juillard et al.

[11] 4,445,545

[45] May 1, 1984

[54] DEVICE FOR WINDING A PIECE OF FABRIC UNDER CONSTANT TENSION, ESPECIALLY FOR A WEAVING LOOM

[75] Inventors: Yves Juillard; Christian Varloud, both of Mulhouse, France

[73] Assignee: Societe Alsacienne de Constructions Mecaniques de Mulhouse, France

[21] Appl. No.: 373,863

[22] Filed: May 3, 1982

[30] Foreign Application Priority Data

May 12, 1981 [FR] France ..... 81 09395
Oct. 27, 1981 [FR] France ..... 81 20126

[51] Int. Cl.[3] ..... D03D 49/20
[52] U.S. Cl. ..... 139/311
[58] Field of Search ..... 139/108, 109, 110, 309, 139/310, 311; 242/67, 75.5, 75.45

[56] References Cited

U.S. PATENT DOCUMENTS

| | | | |
|---|---|---|---|
| 2,226,090 | 12/1940 | Burdett | 139/311 |
| 3,419,050 | 12/1968 | Yoshida | 139/311 |
| 3,710,829 | 1/1973 | Johnson et al. | 139/311 |
| 4,227,554 | 10/1980 | Volland | 139/310 |

*Primary Examiner*—Henry Jaudon
*Attorney, Agent, or Firm*—George H. Gerstman

[57] ABSTRACT

The fabric produced by a loom is wound on a drum which is driven in rotation from the fabric take-up roller by means of a friction coupling, the friction being adjustable by means of a regulating nut. A tensioning roller which is capable of displacement under the action of the tension of the fabric actuates a pawl by means of a mechanism comprising two elbowed levers and a connecting-rod. The pawl is capable of engaging in teeth carried by the regulating nut in order to lock the nut in position and tighten-up the friction coupling when the tension of the fabric decreases.

10 Claims, 5 Drawing Figures

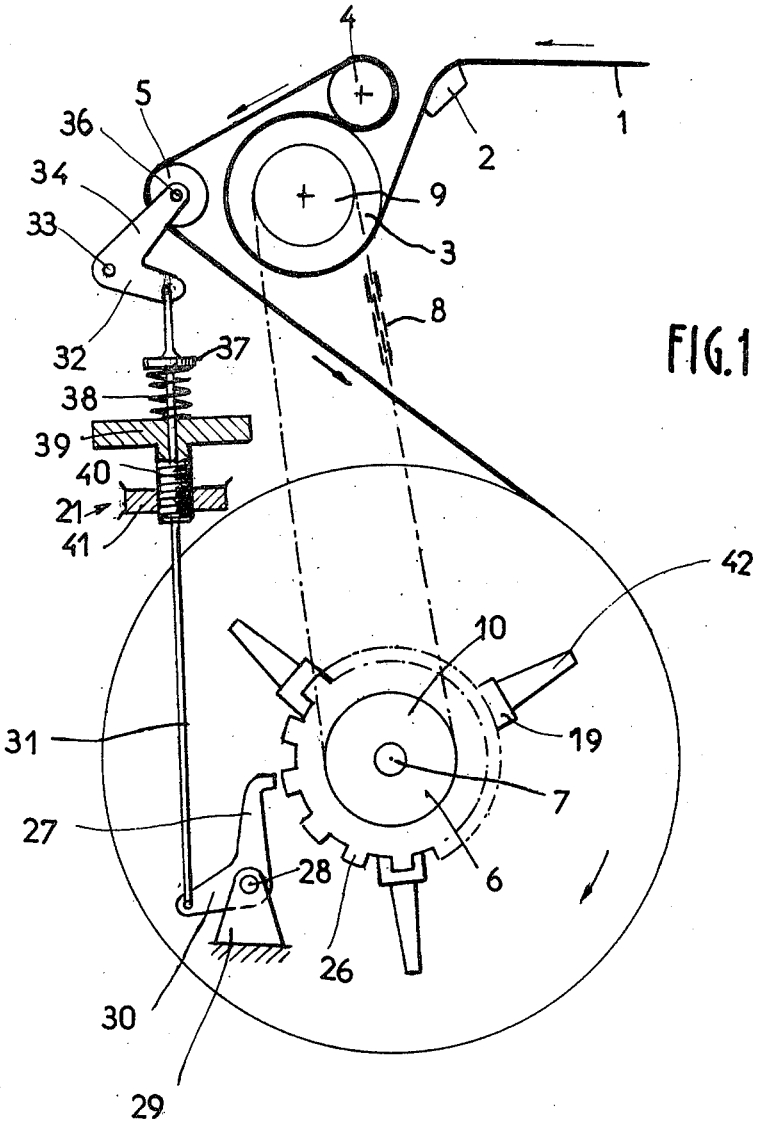
FIG. 1
FIG. 2
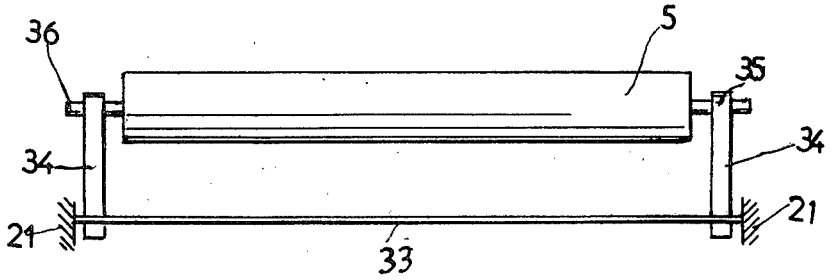

1
2'
100
2
3
9
5
101
36
103
102
4
105
117
8
31
7
10,10'
27
15
19
104
26
42
10₁
6
116
115
114
110
f
111
38
112
113
8'
6'
7'
10₂

8
8'
42
109
16
19
103
18
120
106
118
119
17'
17
14
15
108
20
104
107
11
12
11'
12'
10
10'
42

DEVICE FOR WINDING A PIECE OF FABRIC UNDER CONSTANT TENSION, ESPECIALLY FOR A WEAVING LOOM

This invention relates to the textile industry and more particularly to the field of weaving.

By means of a weaving loom, a textile fabric is produced at a substantially constant speed and taken up by a driving roller known as a drum which rotates about its axis. The speed of rotation of the drum is adjusted when it is initially put into operation in such a manner as to ensure that the length of fabric produced during the time interval corresponding to one revolution is substantially taken up at each revolution. However, the diameter of the piece of fabric increases progressively, with the result that the tension of the fabric decreases after a certain time if the driving torque transmitted to the drum remains constant.

The variation in the driving torque transmitted to the drum is usually obtained by means of a friction device which is set at the time of startup by the weaver, the degree of friction produced by the device being increased by hand as the fabric increases in size. The results achieved by means of this very empirical method are solely dependent on the skill of the operator.

French patent No. 2,428,095 described a device for automatically adjusting the friction as a function of the diameter of the fabric roll. By means of a feeler roller which is in contact with the periphery of the piece of fabric, a cam is caused to rotate and thus to displace a rocker-arm which in turn actuates the friction mechanism in order to produce a variation in the driving torque transmitted to the drum. This device is relatively complicated since the entire unit has to undergo a displacement as the diameter of the piece of fabric increases. Furthermore, the diameter of a roll of fabric is a fairly ill-defined value since it is dependent on the thrust exerted by the feeler roller. In addition, the tension as a function of the diameter of the piece of fabric is predetermined but not measured; the tension is liable to be influenced by a worn friction member, an overstrained spring, and so on.

The present invention has for its object to overcome these disadvantages and accordingly relates to a device for automatically regulating the winding tension of a fabric produced by a weaving loom, in which the winding roller or drum is driven in rotation from the fabric take-up roller by means of a friction device. Said regulating device essentially comprises a roller which is displaceable under the action of the tension of the fabric, and a mechanism for transmitting the displacement of said roller to a device for locking a nut which tightens-up the friction device when the tension of the fabric has decreased.

The invention as hereinabove defined is applicable not only to single-layer weaving looms but also to double-layer looms.

It is in fact well known that some fabrics such as chiffon velvet, for example, are produced in a double fabric layer. The loom is fed by two warp beams and the warp threads thus form two separate sheds, one weft thread being inserted in each shed. Furthermore, a pile yarn beam distributes threads for assembling the two fabric layers which have thus been formed. A cutting device cuts these threads at the center, thus separating the two layers of fabric which are then wound on two separate drums.

One obvious method of maintaining constant tension consists in adapting a friction system of the type defined above to each winding drum. Thus the tension of each piece of fabric is controlled individually but this is a costly solution since each component of the tension regulator is duplicated.

In one advantageous form of construction which is applicable to a loom for weaving two layers of fabric, provision is made for a single device which produces action simultaneously on both drums.

A design concept of this kind would normally be ruled out by those who are versed in the art since it may happen that the pile threads are not cut accurately at the center, in which case this single device would not permit accurate tension control of one layer of fabric, with the result that irregularities may consequently appear in said layer. This disadvantage, however, may become an advantage. In fact, if the tension of one of the fabric layers being wound on a drum is clearly not uniform, this means that the pile yarn cutting operation is faulty and the knife requires to be adjusted in order to correct this defect.

The object of the invention is therefore to provide a device for automatic regulation of the winding tension of the two layers of fabric produced by a velvet weaving loom, in which the two drums are driven respectively in rotation by means of a friction system as hereinabove defined. The regulating device is distinguished by the fact that adjustment of two friction members is controlled from a single feeler which reacts to the variations in tension of only one of the two layers of fabric.

These and other features of the invention will be more apparent to those skilled in the art upon consideration of the following description and accompanying drawings, in which:

FIG. 1 is an end view of the device according to the invention as applied to a single-layer loom;

FIG. 2 is a front view of the fabric tensioning roller;

Figure 3:
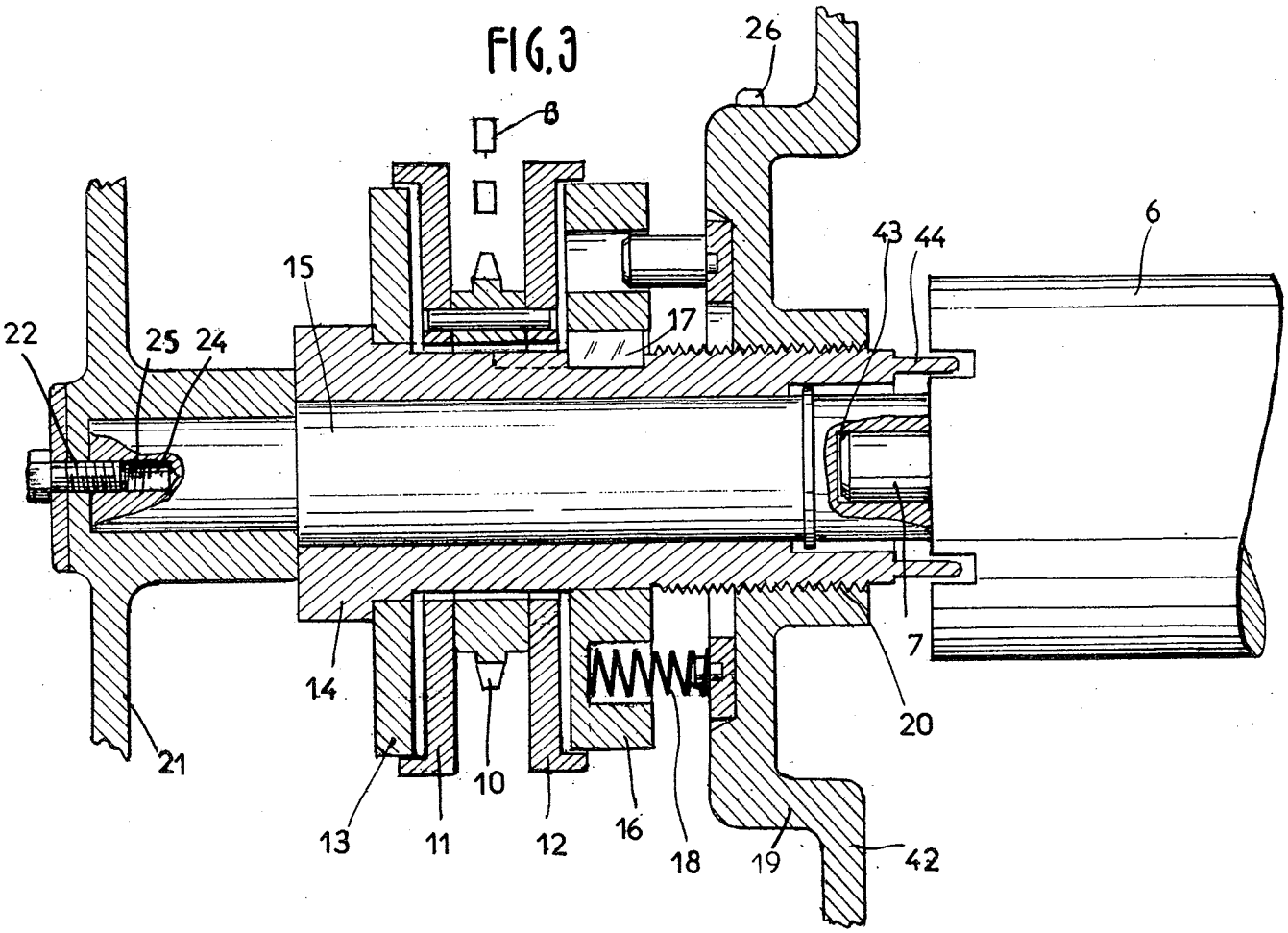
FIG. 3 shows the device according to the invention, looking on the front end of a weaving loom on which the device is mounted.

FIG. 1 shows the fabric 1 supported in a conventional manner on the breast beam 2 which is either stationary or movable and surrounds part of the take-up roller 3, the fabric being applied against said take-up roller by the pressure roller 4. The fabric then passes over a tensioning roller 5 before being wound on the drum 6 which is rotatably mounted on a shaft 7. The winding drum 6 is driven in rotation from the take-up roller 3 by means of any known drive system such as, for example, an endless belt 8 adapted to cooperate with two chain sprocket-wheels 9, 10 which are rotationally coupled respectively to the rollers 3 and 6.

The sprocket-wheel 10 is mounted between two friction members 11, 12 and drives these latter in rotation (as shown in FIG. 3). The first friction member 11 is applied against a plate 13 and this latter is rigidly fixed to a sleeve 14 which surrounds a roller 15. The second friction member 12 is applied against a plate 16 keyed at 17 in the sleeve 14 and coupled by means of a series of springs 18 to a nut 19 which is displaceable along a threaded portion 20 carried by the sleeve 14. The cylinder 15 is secured to the frame 21 of the weaving loom, for example by means of a screw 22 engaged within a blind-end bore 24 which is provided over part of its length with an internal screw-thread 25. The nut 19 is fitted with a toothed ring 26 with which a pawl 27 is adapted to cooperate, said pawl being pivotally mounted at 28 in a bearing 29 which is rigidly fixed to the frame 21. The oscillating motion of the pawl 27 is controlled by a lever-arm 30 and this latter is coupled by means of a rod 31 to an elbowed lever 32 which is controlled by the fabric tensioning roller 5. The lever 32 is pivotally attached to the frame at 33 and provided with a second arm 34 having a bearing 35 for supporting the shaft 36 on which the tensioning roller 5 is rotatably mounted.

As shown in FIG. 2, the two ends of the shaft 36 are engaged in bearings 35 carried respectively by two identical pivotal arms 34, the pivotal motion being performed about the pin 33 which is rigidly fixed to the frame 21. A stop 37 is fixed on the rod 31 and one end of a spring 38 is applied against said stop. The other end of the spring is applied against the annular flange 39 of a threaded member 40 and this latter is screwed into a nut 41 which is rigidly fixed to the frame 21.

The drum 6 is centered by means of its shaft 7 which penetrates into a blind-end bore 43 of the roller 15. The sleeve 14 and the drum 6 are rigidly fixed in rotation by means of a predetermined number of lugs 44.

The operation of the device takes place as follows:

At the moment of positioning of a drum 6, the compression of the spring 38 is set by displacing the threaded member 40 within the nut 41 by hand so as to ensure that the pawl 27 is located in a disengaged position with respect to the toothed wheel 26 at the minimum value of friction on the sprocket-wheel 10. The tension of the fabric then has a predetermined value. When the diameter of the piece of fabric has increased and this latter has slackened, the tensioning roller 5 undergoes a displacement within the bearings 35 (towards the left in FIG. 1) and is accompanied in this movement by the lever arm 34 which produces a displacement of the arm 32 in a movement of oscillation about the pin 33. The rod 31 which is drawn upwards by the arm 32 in turn causes the pawl 27 to undergo a pivotal displacement about its pivot-pin 28, with the result that it comes into contact with the nut 19, then locks this latter by cooperating with the toothed ring 26. The nut which has thus been locked in position is screwed-down on the threaded portion 20 and therefore tightens-up the friction device, with the result that the driving torque transmitted to the drum 6 increases. When said torque has attained the value at which the fabric is restored to its normal tension, the tensioning roller 5 returns to its initial position, this return movement being accompanied by the levers 32 and 34 and therefore by the rod 31 which returns downwards and draws back the pawl 27 which disengages from the toothed ring 26. The nut 19 which is no longer locked in position again rotates with the sleeve 14 until further slackening of the fabric initiates a further engagement of the pawl 27 with the toothed ring 26.

When the piece of fabric has attained the desired diameter, it is lifted-off in known manner and a fresh drum is placed in position. The friction is adjusted to its initial value by unscrewing the nut 19 by means of one of the control levers 42 carried by the nut.

Figure 4:
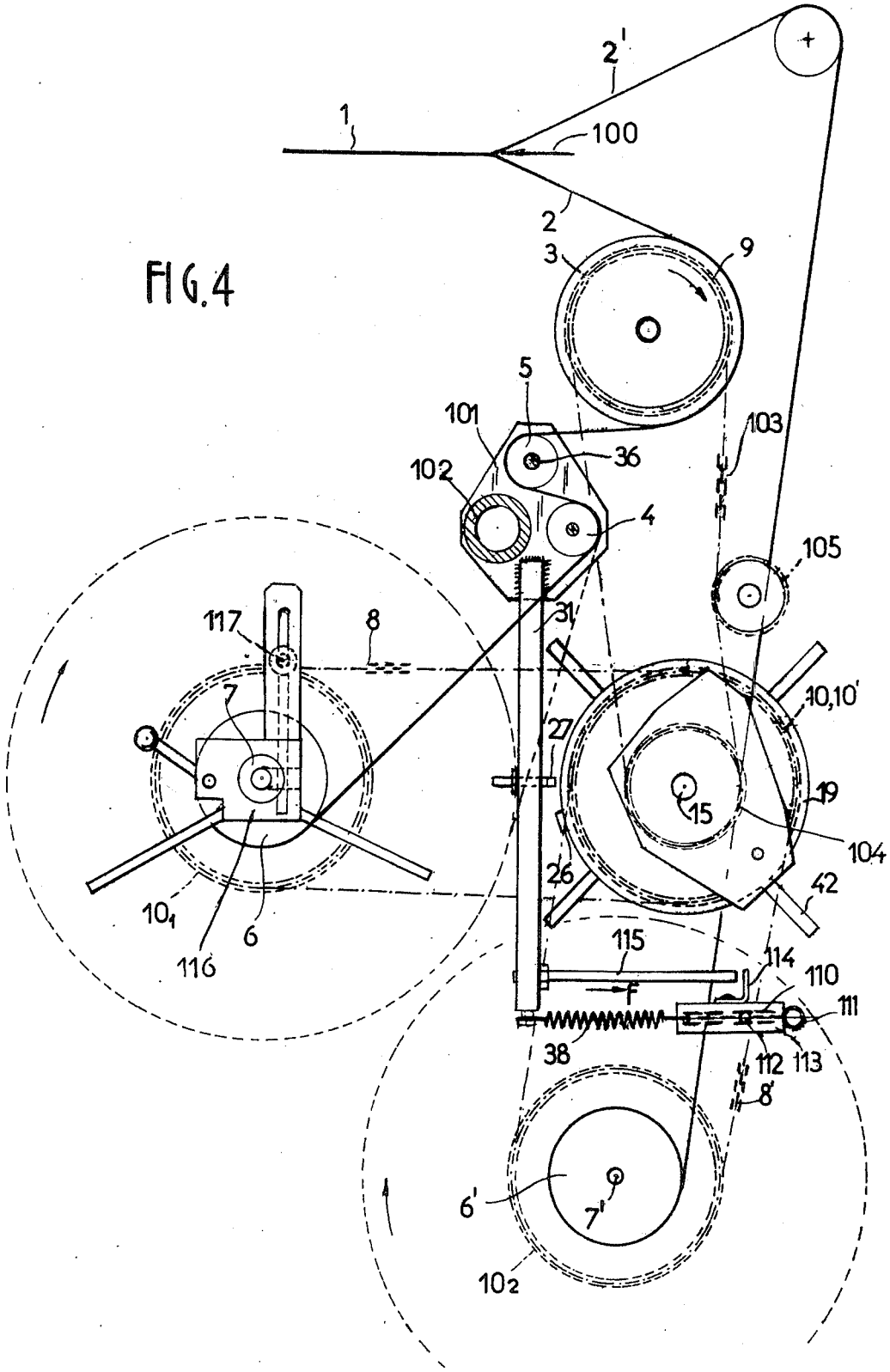
FIG. 4 is a general view of the invention as applied to a double-layer loom.
Figure 5:
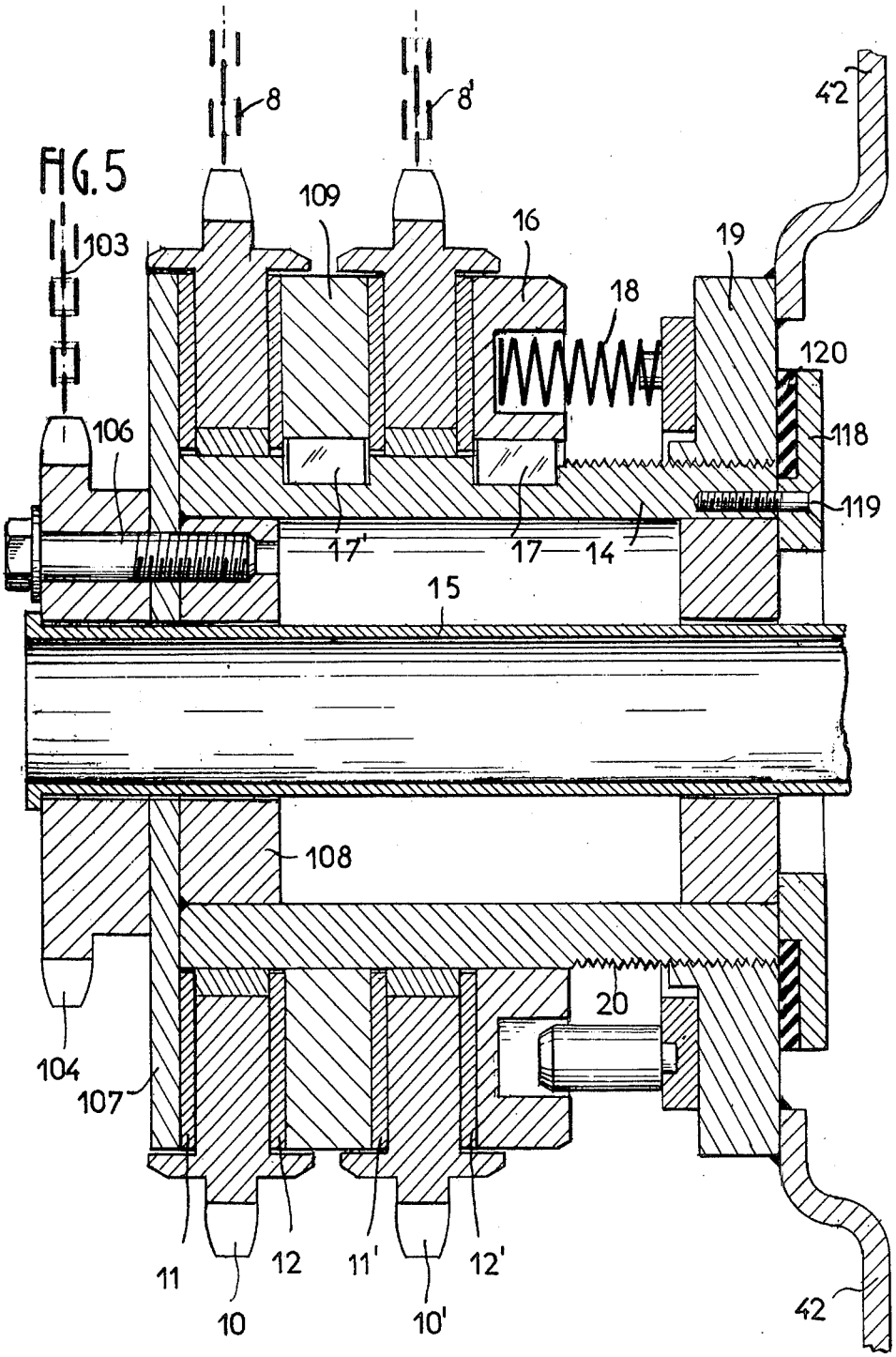
FIG. 5 is a detail view showing the friction members in the device of FIG. 4.

Referring now to FIGS. 4 and 5, consideration will be given to a practical application in which the device according to the invention is employed in a loom for weaving two layers of fabric, especially for the production of velvet.

The weaving loom produces a velvet 1 as shown in FIG. 4. In accordance with known practice, the two velvet layers 2, 2' are joined together by the pile threads (not shown in the figure). These pile threads are cut at the center by means of a cutting device shown diagrammatically at 100. The two layers 2 and 2' each pass over a separate take-up roller, only one of which is shown in the figure, namely the take-up roller 3. The figure shows in greater detail, however, the path of travel of the fabric layer 2, the variations in tension of which are picked-up by the feeler. The fabric 2 then passes over the guide rollers 4, 5 before being wound on the drum 6 which rotates about its shaft 7. Similarly, the fabric 2' is wound on the drum 6' which rotates about its shaft 7'.

The guide rollers 4, 5 are maintained between two plates 101 whose relative spacing is fixed by means of a tube 102. A rod 31 is rigidly fixed to one of the plates 102. The complete assembly is pivotally mounted on the shaft 36 of the guide roller 5.

The take-up roller 3 is rigidly fixed to the sprocket-wheel 9 over which is passed a chain 103 and this latter is also applied against another sprocket-wheel 104 mounted on a cylinder 15 (shown in FIG. 5).

The chain 103 is stretched over a roller 105.

Two additional sprocket-wheels 10 and 10' are mounted respectively between two friction members 11, 12 and 11' and 12' which are driven in rotation by the sprocket-wheel 104. Said sprocket-wheel is keyed at 106 on a plate 107 which is applied against the friction member 11 and on a ring 108 which is rigidly fixed to a sleeve 14. The plates 16 and 109 are keyed respectively at 17 and 17' on said sleeve 14 and serve to drive the friction members 12', 11' and 12 in rotation. The plate 16 is coupled by means of a series of springs 18 to a nut 19 which is displaceable along a threaded portion 20 carried by said sleeve 14.

Two chains 8, 8' are wound respectively on the sprocket-wheels 10, 10' and on sprocket-wheels $10_1$, $10_2$ which are rigidly fixed respectively to the drums 6, 6'.

The cylinder 15 is attached to the frame of the weaving loom by any known means (not shown in the drawings).

The nut 19 is provided with a tooth 26 disposed in cooperating relation with a stud 27 which is secured to the rod 31. The free end of said rod is attached to the end of a spring 38, the other end of which is adapted to carry a short chain 110 terminating in a small ring 111. A locking-pin 112 can be inserted both in one of the links of the small chain and in a hole drilled in a stationary member 113. Said member 113 is adapted to carry a right-angle bracket 114 and this latter serves as a stop for a bar 115 which is attached to the rod 31.

The operation of the device takes place as follows:

At the beginning of the weaving operation, the drums 6 and 6' are placed in position. The mounting system is shown in FIG. 4 only in the case of the drum 6 since the same system is adopted for the drum 6'. The ends of the shaft 7 of the drum 6 are inserted in the bearings 116 which are rigidly fixed to the frame of the loom. The spindle 117 serves to imprison the shaft 7 within its bearing 116. By introducing a finger within the small ring 111, the operator can readily exert a pulling force on the short chain 110 in order to subject the spring 38 to a predetermined movement of expansion. A winding tension of the fabric 2 corresponds to each expansion of the spring 38. When the length of the spring 38 corresponding to the desired winding tension is obtained, the locking-pin 112 is inserted in the link located opposite to the hole drilled in the member 113 in order to maintain the spring in the state of tension in which it has been placed.

The distance between the end of the rod 115 and the right-angle bracket 114 is proportional to the distance between the tooth 26 and the stud 27. When the weaving loom is in operation, these two components are not visible and it is for this reason that provision has been made for the visual display system 114, 115.

As the diameter of winding of fabric on the drum increases, the tension of the fabric decreases and the rod 31 undergoes a displacement in the direction of the arrow F about the shaft 36. At a given moment, the stud 27 encounters the tooth 26 and locks the nut 19 which is accordingly screwed on the threaded portion 20, thus tightening-up the friction members 11, 12 and 11', 12'. Thus the driving torque transmitted to the drums increases. When said torque attains the value at which the fabric is restored to its initial tension, the rod 31 returns to its starting position, thus displacing the stud 27 which disengages from the tooth 26. The nut 19 is thus released and again rotates with the sleeve 14 until further slackening of the fabric 2 causes the stud 27 to re-engage with the tooth 26 and therefore to re-tighten the friction members.

When the pieces of fabric which have been wound on the drums 6 and 6' attains the desired diameter, they are lifted-off in known manner and fresh winding drums are then placed in position. The friction members are slackened-off by unscrewing the nut 19 by means of the control levers 42 carried by the periphery of said nut. In order to guard against excessive unscrewing of the nut which would be liable to cause the springs 18 to escape from their housings, a stop 118 which is secured to the sleeve 14 by means of the screw 119, for example, serves to limit the displacement of the nut. Sudden impact of the nut 19 on the stop 118 is prevented by means of a plate 120 of rubber or of any other suitable elastic material which is interposed between the nut and its stop.

This mode of regulation of the winding tension of a fabric produced in a double layer is not limited to chiffon velvet but may be extended to any weaving machine which is designed for simultaneous production of two pieces of fabric by means of two superposed sheds in which two weft inserters operate simultaneously.

What is claimed is:

1. A device for automatically regulating the winding tension of a fabric produced by a weaving loom, in which the winding roller or drum is driven in rotation from the fabric take-up roller by means of a friction coupling, wherein said regulating device comprises a tensioning roller which is displaceable under the action of the tension of the fabric, and a mechanism for transmitting the displacement of said roller to a device for locking a nut which tightens-up the friction coupling when the tension of the fabric has decreased.

2. A device according to claim 1, wherein the locking device is composed of a toothed ring rigidly fixed to the nut and of a pawl controlled by the tensioning roller so as to engage with said toothed ring when the tension of the fabric has decreased.

3. A device according to claim 2, wherein the pawl is actuated by means of a rod rigidly fixed to a lever which amplifies the displacements of the tensioning roller.

4. A device according to claim 1, wherein the tension of the fabric is determined by adjusting the compression of a spring fixed between the pawl-actuating rod and the frame of the weaving loom.

5. A device according to claim 1, wherein the nut is provided with means for releasing said nut by hand in order to restore the friction to its initial value when a fresh drum is placed in position.

6. A device according to claim 1 for automatically regulating the winding tension of two layers of fabric produced by a weaving loom in which the two drums are driven respectively in rotation by means of a friction device, wherein tightening-up of the two pairs of friction members is controlled from a single feeler which reacts to the variations in tension of only one of the two fabric layers.

7. A device according to claim 6, wherein the system for tightening-up the friction members is composed of a tooth rigidly fixed to the nut which serves to tighten-up the friction members and of a stud controlled by the tensioning roller so as to engage with said tooth when the tension of the fabric has decreased.

8. A device according to claim 7, wherein a visible indication of the distance between the tooth and the nut-locking stud is provided at each instant by means of a display system.

9. A device according to claim 6, wherein the range of travel of the nut at the moment of slackening of the friction members is limited by a stop.

10. A device according to claim 9, wherein a resilient member is interposed between the nut and its stop.

* * * * *